US012565346B2

(12) United States Patent
Higashi et al.

(10) Patent No.: US 12,565,346 B2
(45) Date of Patent: Mar. 3, 2026

(54) CHEMICAL SOLUTION ENCLOSING DEVICE AND CHEMICAL SOLUTION ENCLOSING METHOD

(71) Applicants: KYOTO SEISAKUSHO CO., LTD., Kyoto (JP); CHUGAI SEIYAKU KABUSHIKI KAISHA, Tokyo (JP)

(72) Inventors: Hiroaki Higashi, Kyoto (JP); Keiji Hirota, Tokyo (JP); Hideaki Hosaka, Tokyo (JP)

(73) Assignees: KYOTO SEISAKUSHO CO., LTD., Kyoto (JP); CHUGAI SEIYAKU KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/845,762

(22) PCT Filed: Feb. 13, 2023

(86) PCT No.: PCT/JP2023/004795
§ 371 (c)(1),
(2) Date: Sep. 10, 2024

(87) PCT Pub. No.: WO2023/176244
PCT Pub. Date: Sep. 21, 2023

(65) Prior Publication Data

US 2025/0187762 A1 Jun. 12, 2025

(30) Foreign Application Priority Data

Mar. 14, 2022 (JP) ..... 2022-039576

(51) Int. Cl.
*B65B 3/00* (2006.01)

(52) U.S. Cl.
CPC ..... *B65B 3/003* (2013.01)

(58) Field of Classification Search
CPC ..... A61M 5/178; B65B 3/003
See application file for complete search history.

(56) References Cited

U.S. PATENT DOCUMENTS 6,223,408 B1 5/2001 Vetter et al.
7,927,315 B2 * 4/2011 Sudo ..... A61M 5/5013 604/218

(Continued)

FOREIGN PATENT DOCUMENTS

JP 1994-285166 A 10/1994
JP 1997-103484 A 4/1997

(Continued)

OTHER PUBLICATIONS

International Search Report and Written Opinion, International Patent Application No. PCT/JP2023/004795, with English translation of Search Report (11 pages).

*Primary Examiner* — Eyamindae C Jallow
(74) *Attorney, Agent, or Firm* — HSML P.C.

(57) ABSTRACT

A chemical solution enclosing device that inserts a plug into a barrel containing a chemical solution includes, a sleeve inserted into a barrel in such a manner that a tip end of the sleeve comes near a liquid surface of the chemical solution, a push rod pushing the plug inserted in the sleeve; and a suction depressurization device that draws air inside of the barrel that is isolated from outer air through a gap between an outer peripheral surface of the sleeve and an inner peripheral surface of the barrel to depressurize inside of the barrel. After the suction depressurization device depressurizes the inside of the barrel to a predetermined pressure, the push rod is advanced to push the plug from inside of the sleeve into the barrel, with a depressurized state maintained. The sleeve is withdrawn from the barrel after at least a part of an outer peripheral surface of the plug comes into fluid-tight contact with the inner peripheral surface of the barrel.

19 Claims, 11 Drawing Sheets

(56) References Cited

U.S. PATENT DOCUMENTS

| | | | | |
|---|---|---|---|---|
| 10,561,795 | B2 * | 2/2020 | Giraud | A61M 5/3129 |
| 2006/0168916 | A1 | 8/2006 | Griebel et al. | |
| 2008/0300550 | A1 * | 12/2008 | Schiller | A61M 5/31511 604/222 |
| 2016/0146346 | A1 * | 5/2016 | Shimizu | A61M 5/31511 29/446 |
| 2020/0155760 | A1 * | 5/2020 | Dix | A61M 5/1782 |

FOREIGN PATENT DOCUMENTS

| | | | | |
|---|---|---|---|---|
| JP | 1997-299480 | A | 11/1997 | |
| JP | 1988-109872 | A | 5/1998 | |
| JP | 2001-061963 | A | 3/2001 | |
| JP | 2020-531057 | A | 11/2020 | |
| WO | 2015-016170 | A1 | 2/2015 | |
| WO | WO-2019244063 | A1 * | 12/2019 | A61M 5/1782 |

* cited by examiner

CHEMICAL SOLUTION ENCLOSING DEVICE AND CHEMICAL SOLUTION ENCLOSING METHOD

TECHNICAL FIELD

The present disclosure relates to a chemical solution enclosing device and a chemical solution enclosing method for inserting a plug into a barrel of a syringe containing a chemical solution.

BACKGROUND ART

As an example, Patent Document 1 discloses a method for enclosing a chemical solution by inserting a plug into a barrel containing a chemical solution. The method described in Patent Document 1 is carried out in a vacuum chamber. To begin with, an air vent needle is placed inside the barrel in such a manner that the tip end thereof is at a position near the liquid surface of the chemical solution inside the barrel. In this configuration, the plug is inserted into the barrel. When the plug is pushed further to reach a predetermined position inside the barrel, the air vent needle is removed from the barrel. The inside of the vacuum chamber is then returned to the normal pressure, and the barrel having the plug inserted is taken out from the vacuum chamber. As a result, a prefilled syringe in which a chemical solution is enclosed with a formation of air bubbles inhibited is manufactured.

PRIOR ART DOCUMENT

Patent Document

Patent Document 1: JP-A H6-285166

SUMMARY OF THE INVENTION

Problems to be Solved by the Invention

However, with the chemical solution enclosing method described in Patent Document 1, the process of inserting the plug into the barrel in the vacuum chamber is performed for a plurality of syringes at once, that is, as batch processing. Therefore, when a large number of prefilled syringes are to be manufactured, it is necessary to prepare a large vacuum chamber or a large number of vacuum chambers, and as a result, the size of the device for enclosing a chemical solution is increased.

Therefore, an object of the present disclosure is to insert a plug into a barrel containing a chemical solution without increasing the size of the device.

Solutions to the Problems

In order to solve the above problems, according to one aspect of the present disclosure, provided is a chemical solution enclosing device that inserts a plug into a barrel containing a chemical solution, the chemical solution enclosing device comprising:

a barrel holder unit configured to hold the barrel;

a sleeve inserted into the barrel held by the barrel holder unit in such a manner that a tip end of the sleeve comes near a liquid surface of the chemical solution;

a push rod configured to push the plug inserted in the sleeve; and a suction depressurization device that draws air inside of the barrel that is isolated from outer air, the air being drawn through a gap between an outer peripheral surface of the sleeve and an inner peripheral surface of the barrel to depressurize inside of the barrel, wherein after the suction depressurization device depressurizes the inside of the barrel to a predetermined pressure, the push rod is advanced to push the plug from inside of the sleeve into the barrel, with a depressurized state maintained, and the sleeve is withdrawn from the barrel after at least a part of an outer peripheral surface of the plug comes into fluid-tight contact with the inner peripheral surface of the barrel.

According to another aspect of the present disclosure, provided is a chemical solution enclosing method for inserting a plug into a barrel containing a chemical solution, the chemical solution enclosing method comprising:

inserting a sleeve into the barrel in such a manner that a tip end of the sleeve comes near a liquid surface of the chemical solution;

inserting the plug into the sleeve;

drawing air inside of the barrel that is isolated from outer air, the air being drawn through a gap between an outer peripheral surface of the sleeve and an inner peripheral surface of the barrel, using a suction depressurization device, to depressurize the inside of the barrel;

advancing the plug from inside of the sleeve into the barrel, after the suction depressurization device depressurizes the inside of the barrel to a predetermined pressure, with a depressurized state maintained; and withdrawing the sleeve out of the barrel after at least a part of the outer peripheral surface of the plug comes into fluid-tight contact with the inner peripheral surface of the barrel.

Effects of the Invention

According to the present disclosure, it is possible to insert a plug into a barrel containing a chemical solution, without increasing the size of the device.

DETAILED DESCRIPTION

Figure 1:
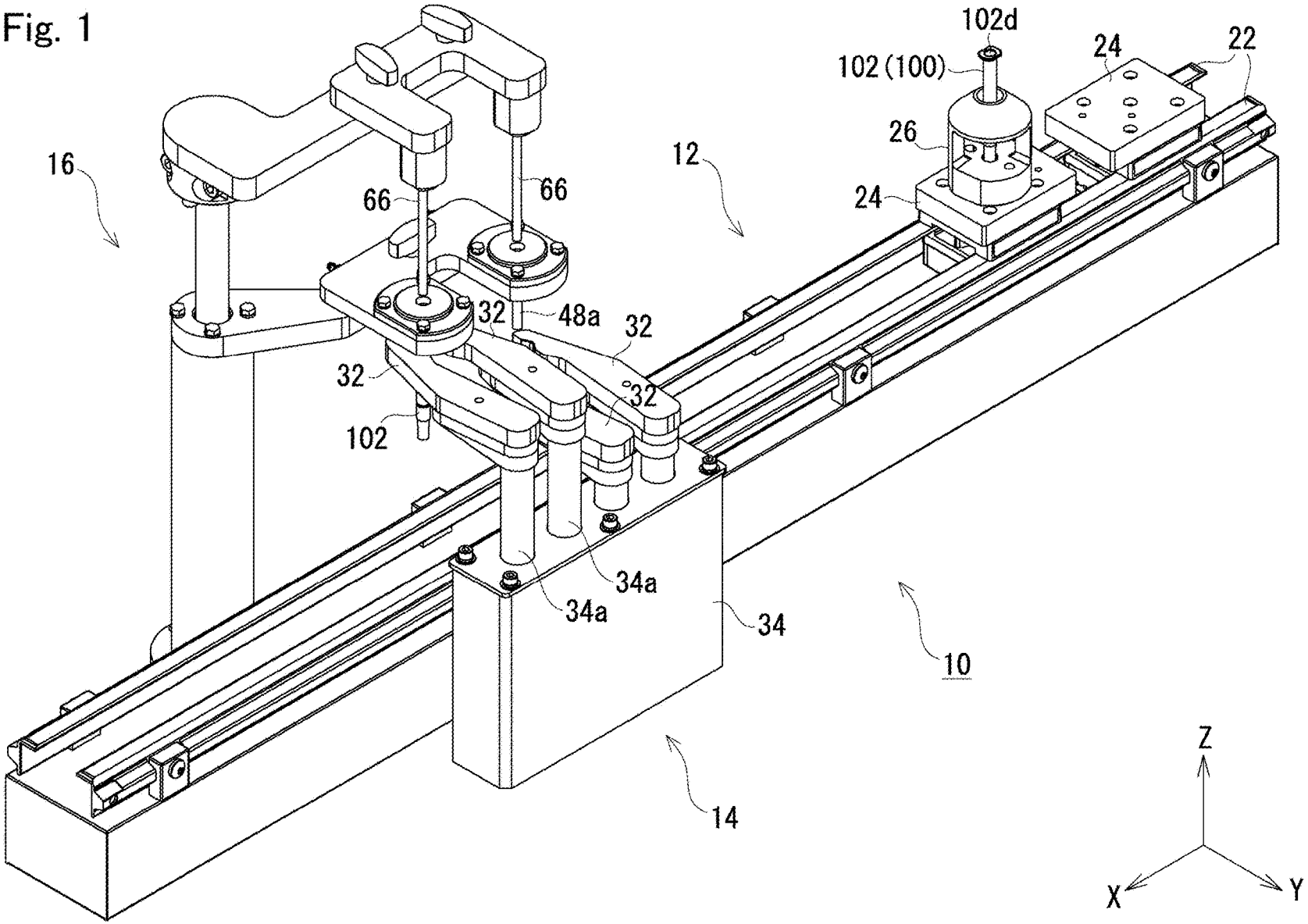
FIG. 1 is a perspective view of a chemical solution enclosing device according to one embodiment of the present disclosure.

A chemical solution enclosing device according to one aspect of the present disclosure is a chemical solution enclosing device that inserts a plug into a barrel containing a chemical solution includes, a barrel holder unit configured to hold the barrel, a sleeve inserted into the barrel held by the barrel holder unit in such a manner that a tip end of the sleeve comes near a liquid surface of the chemical solution; a push rod configured to push the plug inserted in the sleeve, and a suction depressurization device that draws air inside of the barrel that is isolated from outer air, the air being drawn through a gap between an outer peripheral surface of the sleeve and an inner peripheral surface of the barrel to depressurize inside of the barrel, wherein after the suction depressurization device depressurizes the inside of the barrel to a predetermined pressure, the push rod is advanced to push the plug from inside of the sleeve into the barrel, with a depressurized state maintained, and the sleeve is withdrawn from the barrel after at least a part of an outer peripheral surface of the plug comes into fluid-tight contact with the inner peripheral surface of the barrel.

According to such an aspect, it is possible to insert a plug into a barrel containing a chemical solution without increasing the size of the device.

For example, the pump may start depressurizing the inside of the barrel after the plug is positioned to the tip end of the sleeve.

For example, after the push rod is stopped being moved once a part of the outer peripheral surface of the plug comes into fluid-tight contact with the inner peripheral surface of the barrel, the sleeve may be withdrawn from the barrel without moving the push rod.

For example, the barrel holder unit may include a pair of clamping claws that clamp the barrel in radial directions of the barrel.

For example, the barrel holder unit may be configured to raise and to lower the barrel.

A chemical solution enclosing method according to another aspect of the present disclosure is a chemical solution enclosing method for inserting a plug into a barrel containing a chemical solution includes, inserting a sleeve into the barrel in such a manner that a tip end of the sleeve comes near a liquid surface of the chemical solution, inserting the plug into the sleeve, drawing air inside of the barrel that is isolated from outer air, the air being drawn through a gap between an outer peripheral surface of the sleeve and an inner peripheral surface of the barrel, using a suction depressurization device, to depressurize the inside of the barrel, advancing the plug from inside of the sleeve into the barrel, after the suction depressurization device depressurizes the inside of the barrel to a predetermined pressure, with a depressurized state maintained, and withdrawing the sleeve out of the barrel after at least a part of the outer peripheral surface of the plug comes into fluid-tight contact with the inner peripheral surface of the barrel.

According to such an aspect, it is possible to insert a plug into a barrel containing a chemical solution without increasing the size of the device. As the suction depressurization device, a pump or an ejector are used.

An embodiment of the present disclosure will now be explained with reference to some drawings.

Figure 2:
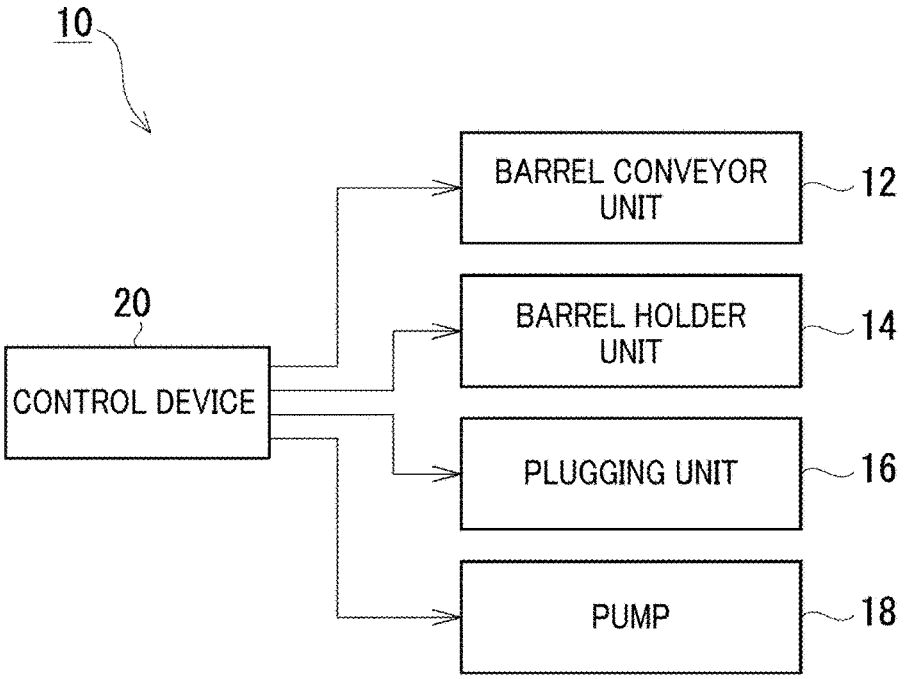
FIG. 2 is a block diagram illustrating a control system of the chemical solution enclosing device.
Figure 3:
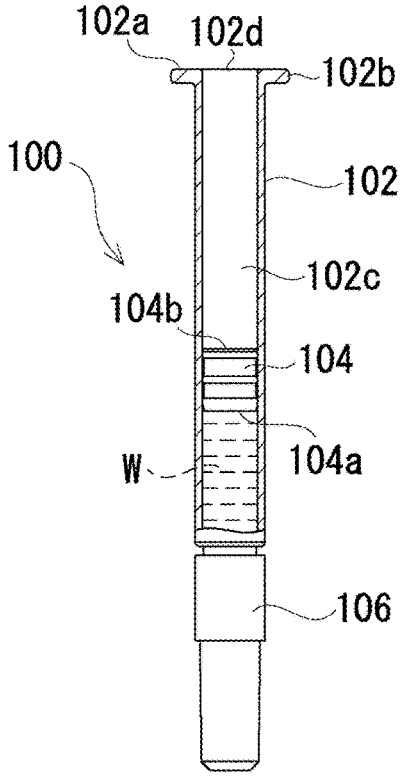
FIG. 3 is a partial cross-sectional view of a prefilled syringe.

FIG. 1 is a perspective view of a chemical solution enclosing device according to one embodiment of the present disclosure. FIG. 2 is a block diagram illustrating a control system of a component conveyance system. FIG. 3 is a partial cross-sectional view of a prefilled syringe.

Note that the X-Y-Z Cartesian coordinate system illustrated in the drawings is for facilitating understanding of the present disclosure, and is not intended to limit the scope of the embodiment according to the present disclosure in any way. In this X-Y-Z Cartesian coordinate system, the X-axis direction and the Y-axis direction represent the horizontal directions, and the Z-axis direction represents the vertical direction.

As illustrated in FIGS. 1 and 2, this chemical solution enclosing device 10 according to the present embodiment includes a barrel conveyor unit 12 that conveys the barrel 102 of a prefilled syringe 100, a barrel holder unit 14 that holds the barrel 102, a plugging unit 16 that inserts a plug 104 into the barrel 102 held in the barrel holder unit 14, a pump 18 that is a suction depressurization device, and a control device 20 that controls these components.

As illustrated in FIG. 3, the chemical solution enclosing device 10 manufactures the prefilled syringe 100 by inserting the plug 104 into the barrel 102 that contains the chemical solution W.

The barrel 102 of the prefilled syringe 100 has a cylindrical shape, and is made of a resin material, for example. A cap 106 is attached to a distal end of the barrel 102 (the end on which a syringe needle is attached). A finger flange 102*b* is provided on a proximal end 102*a* of the barrel 102, on the opposite side of the distal end. The proximal end 102*a* of the barrel 102 also has an opening 102*d* communicating with the internal space 102*c* of the barrel 102 containing the chemical solution W.

The plug 104 of the prefilled syringe 100 is a substantially cylindrical body, and is made of an elastic material such as a rubber material. The plug 104 has a tip end 104*a* that comes into contact with the chemical solution W, and a rear end 104*b* that is connected to a plunger (not illustrated) when the prefilled syringe 100 is used. The plug 104 also elastically deforms, and fluid-tightly comes into contact with the inner peripheral surface of the barrel 102.

The term "fluid-tight contact" as used herein means for two objects being in contact with each other in a manner not permitting any fluid such as a liquid or a gas to pass through therebetween.

The chemical solution enclosing device 10 is configured to insert the plug 104 into the internal space 102*c* of the barrel 102 from the tip end 104*a*, through the opening 102*d* of the barrel 102.

In the example according to the present embodiment, the barrel conveyor unit 12 of the chemical solution enclosing device 10 is configured to convey the barrel 102 containing the chemical solution W from a chemical solution filling position (not illustrated) where the chemical solution W is filled in the barrel 102, toward a plug insertion position where the plugging unit 16 inserts the plug 104 into the barrel 102.

The barrel conveyor unit 12 includes a guide rail 22 extending toward the plugging unit 16, and a slide table 24 that is movable along the guide rail 22 and on which the barrel 102 is placed. A jig 26 provided on the slide table 24 supports the barrel 102 in the direction in which the opening 102*d* faces upwards.

Note that the form of the barrel conveyor unit 12 is not limited as long as the barrel conveyor unit 12 can convey the barrel 102 containing the chemical solution W, with the opening 102*d* facing upwards.

The barrel holder unit 14 of the chemical solution enclosing device 10 is configured to hold the barrel 102 while the plug 104 is being inserted into the barrel 102. In the example according to the present embodiment, the barrel holder unit 14 includes a pair of clamping claws 32 for clamping the barrel 102 in the radial directions, the barrel 102 being held on the slide table 24 at the plug insertion position, as a result of having been conveyed by the barrel conveyor unit 12. In the example according to the present embodiment, the barrel holder unit 14 is configured to move the barrel 102 up and down, by moving the pair of clamping claws 32 up and down, in the manner to be described later in detail. To achieve this end, each of the clamping claws 32 is configured pivotably about a fulcrum line extending in the height direction (Z-axis direction), and is mounted on the tip end of a rod 34*a* of an actuator 34 that is advanced and retracted in the height direction.

Note that, as long as the barrel holder unit 14 can hold the barrel 102 while the plug 104 is being inserted into the barrel 102, the shape of the barrel holder unit 14 is not limited to any shape. A pair of clamping claws 32 is capable of clamping the barrels 102 having different outer diameters. As a result, versatility of the barrel holder unit 14 is improved.

Figure 4:
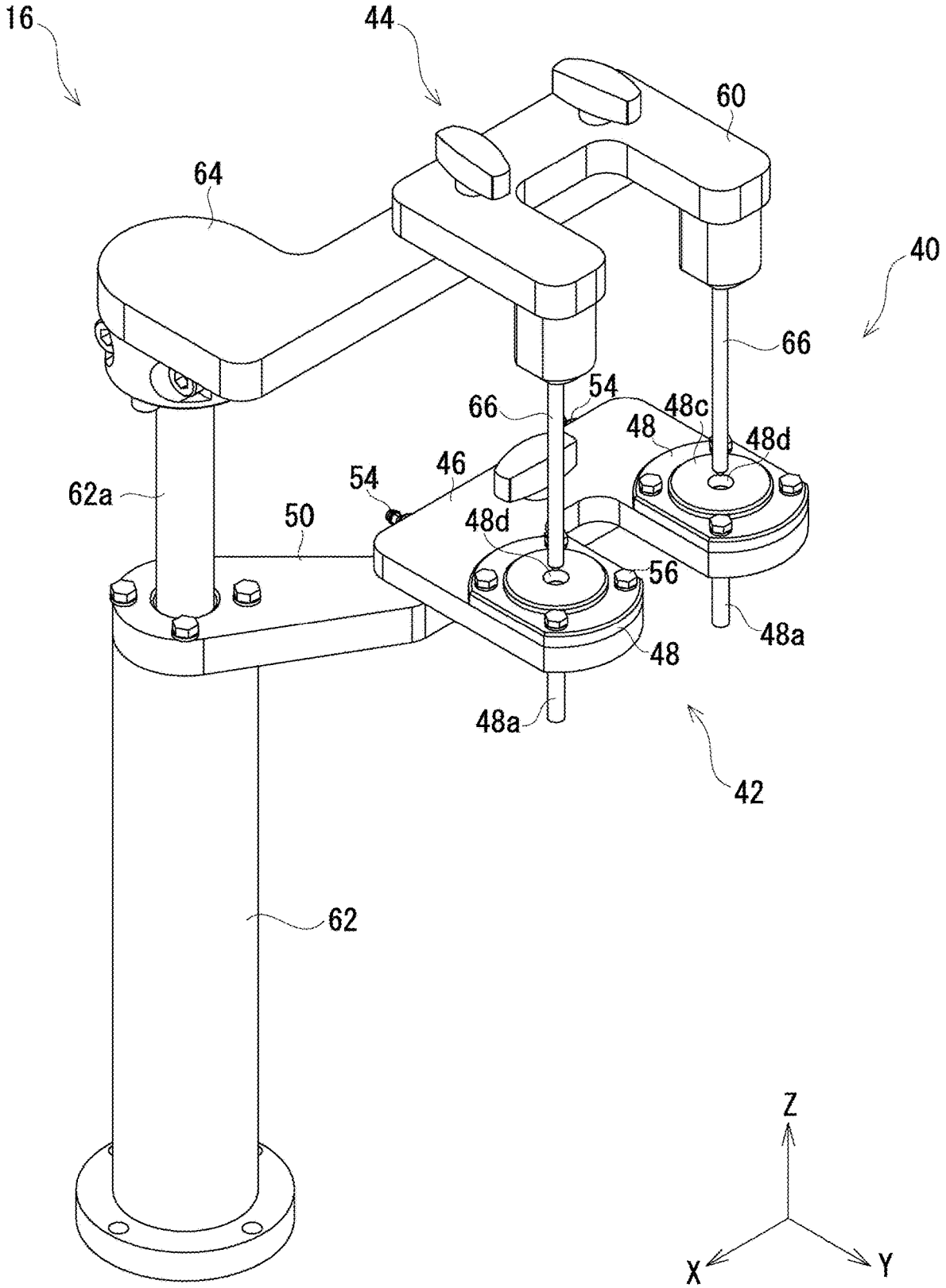
FIG. 4 is a perspective view of a plugging unit included in the chemical solution enclosing device.
Figure 5:
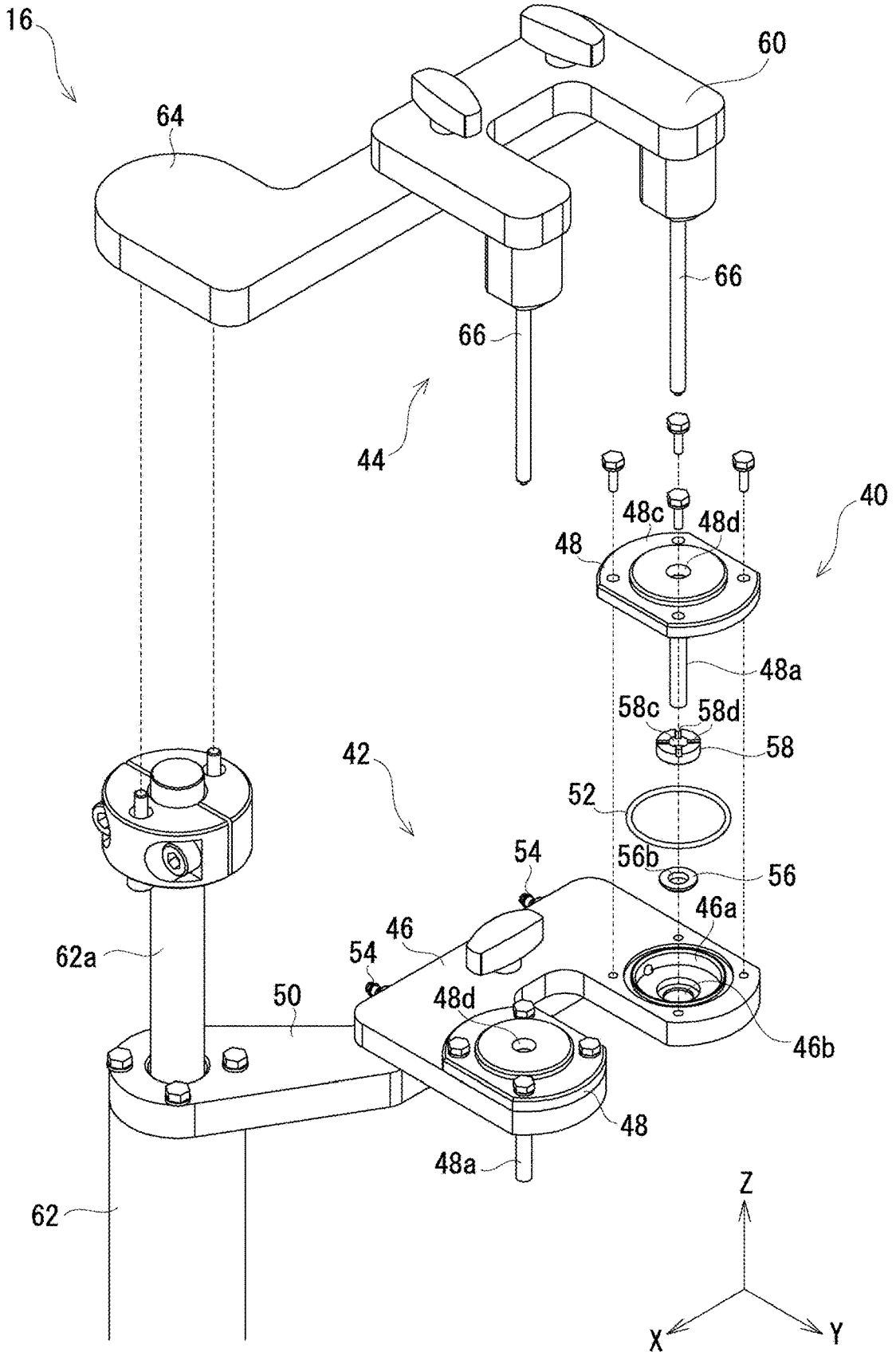
FIG. 5 is an exploded perspective view of the plugging unit.
Figure 6:
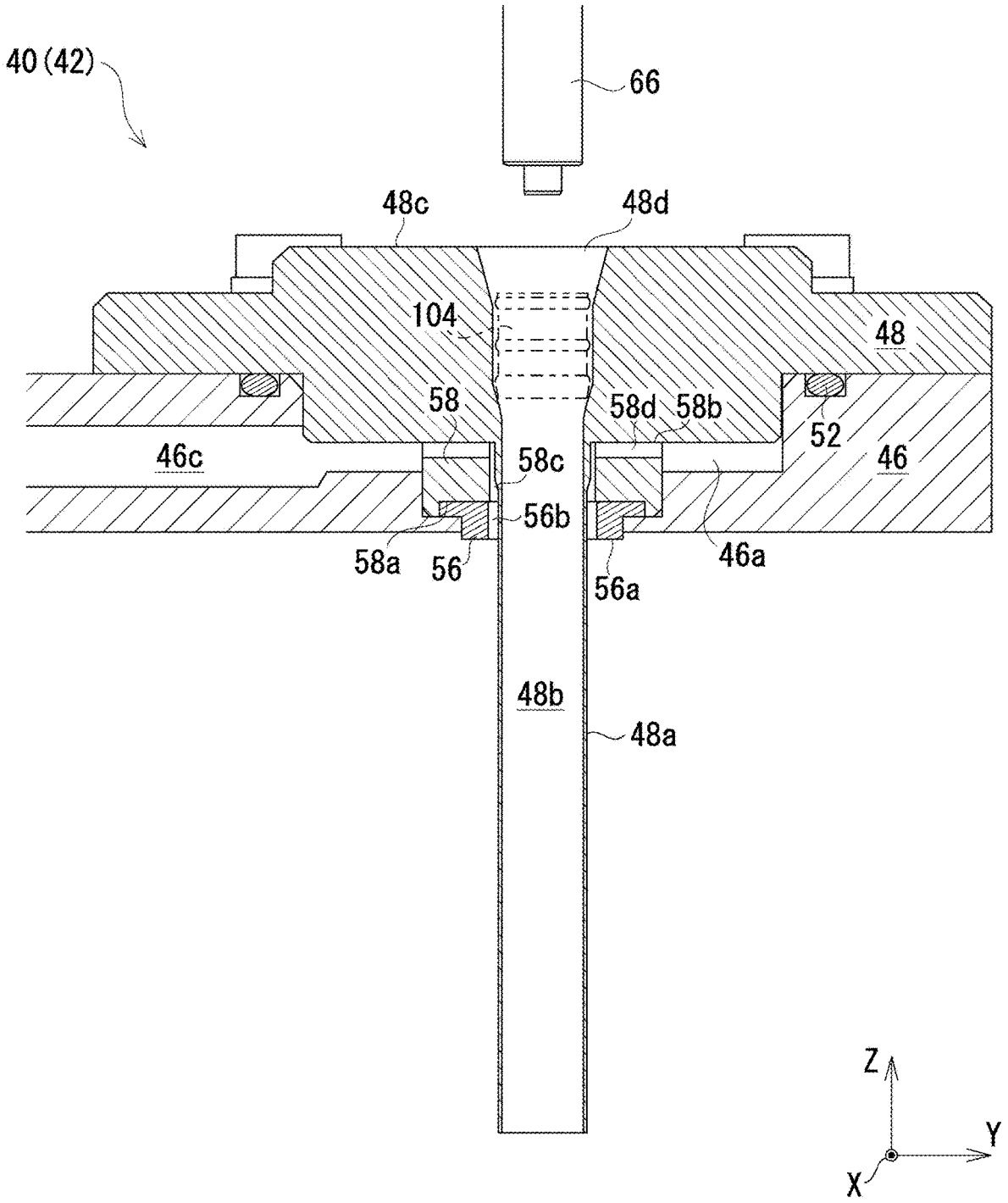
FIG. 6 is a partial cross-sectional view of a plugging head of the plugging unit.

FIG. 4 is a perspective view of the plugging unit of the chemical solution enclosing device. FIG. 5 is an exploded perspective view of the plugging unit. FIG. 6 is a partial cross-sectional view of a plugging head of the plugging unit.

The plugging unit 16 of the chemical solution enclosing device 10 illustrated in FIGS. 4 to 6 is configured to insert the plug 104 into the barrel 102 containing the chemical solution W. In the example according to the present embodiment, the plugging unit 16 includes a plugging head 40 for inserting the plug 104 into the barrel 102 held in the barrel holder unit 14.

In the example according to the present embodiment, the plugging head 40 includes a fixed head 42 that is at a fixed position in the height direction (Z-axis direction), and a movable head 44 movable in the height direction.

The fixed head 42 includes a base member 46 and a cover member 48 attached to the base member 46.

The base member 46 is mounted removably on a fixed arm 50. A recessed chamber 46*a* is provided inside the base member 46. The chamber 46*a* is sealed by being covered by the cover member 48. A sealing ring 52 sealing the gap between the base member 46 and the cover member 48 is provided between the base member 46 and the cover member 48. The chamber 46*a* has a through hole 46*b*, the purpose of which will be described later, in a manner passing through the bottom surface of the chamber 46*a* in the height direction (Z-axis direction).

As illustrated in FIG. 6, the base member 46 has an internal channel 46*c* via which the chamber 46*a* is connected with the pump 18. To the outlet of the internal channel 46*c*, an air coupler 54 is attached to connect an air tube (not illustrated) extending from the pump 18. The pump 18 draws the air inside the chamber 46*a* through the internal channel 46*c* and the air coupler 54, for the purpose to be described later.

The cover member 48 is fixed to the base member 46 using screws, for example. The cover member 48 also has a cylindrical sleeve 48*a* integrated thereto, and to be inserted into the barrel 102 held by the barrel holder unit 14. The sleeve 48*a* has an outer diameter smaller than the inner diameter of the barrel 102, so that a gap is formed between the outer peripheral surface of the sleeve 48*a* and the inner peripheral surface of the barrel 102.

The sleeve 48*a* extends downwards and passes through the through hole 46*b* provided to the bottom surface of the chamber 46*a* of the base member 46. The sleeve 48*a* has a cylindrical internal space 48*b* into which the plug 104 can be inserted. The top surface 48*c* of the cover member 48 has an opening 48*d* communicating with the internal space 48*b* of the sleeve 48*a* so that the plug 104 is inserted into the internal space 48*b* therethrough. Note that it is also possible to attach a separate sleeve to the cover member 48 instead of the sleeve 48*a* integrated with the cover member 48.

As illustrated in FIG. 6, a cylindrical seal member 56 having a contact surface 56*a* coming into contact with a proximal end 102*a* of the barrel 102 is inserted into the through hole 46*b* of the base member 46. The seal member 56 is made of an elastic material such as a rubber material. The seal member 56 has a through hole 56*b* through which the sleeve 48*a* of the cover member 48 is passed. The through hole 56*b* has such an inner diameter by which a gap is formed between the inner peripheral surface of the through hole 56*b* and the outer peripheral surface of the sleeve 48*a*, the gap being capable of passing the air for the purpose to be described later.

A cylindrical seal pressing member 58, having the bottom end surface 58*a* coming into contact with the seal member 56 and the top end surface 58*b* coming into contact with the cover member 48, is inserted into the through hole 46*b* of the base member 46. The base member 46 and the seal member 56 come into close contact with each other by being pressed by the seal pressing member 58, and the base member 46 and the seal member 56 fluid-tightly come into contact with each other.

The seal pressing member 58 has a through hole 58*c* through which the sleeve 48*a* of the cover member 48 is passed. The through hole 58*c* has such an inner diameter by which a gap is formed between the inner peripheral surface of the through hole 58*c* and the outer peripheral surface of the sleeve 48*a*, the gap being capable of passing the air for the purpose to be described later. On the top end surface 58*b* of the seal pressing member 58, a plurality of grooves 58*d* communicably connecting the inside of the through hole 58*c* and the chamber 46*a* of the base member 46 are provided.

Therefore, the chamber 46*a* of the base member 46 is communicated with the outside, via the grooves 58*d* on the seal pressing member 58, via the gap between the through hole 58*c* of the seal pressing member 58 and the sleeve 48*a* of the cover member 48, and via the gap between the through hole 56*b* of the seal member 56 and the sleeve 48*a*.

As illustrated in FIG. 5, the movable head 44 of the plugging unit 16 includes a base member 60. The base member 60 is mounted removably to a movable arm 64. The movable arm 64 is mounted on the tip end of a rod 62*a* included in an actuator 62 configured to move back and forth in the height direction (Z-axis direction).

The base member 60 of the movable head 44 has a push rod 66 extending downwards, and to be inserted into the sleeve 48*a* of the cover member 48 of the fixed head 42. As the movable head 44 is lowered, the push rod 66 pushes down the plug 104 inserted in the sleeve 48*a*, as will be described later in detail.

In the present embodiment, the base member 46 of the fixed head 42 is mounted removably on the fixed arm 50, and the base member 60 of the movable head 44 is mounted removably on the movable arm 64. Therefore, merely by preparing plugging heads 40 matching different types of prefilled syringes 100 (that is, merely by preparing a pair of a fixed head 42 and a movable head 44 having a sleeve 48*a* and a push rod 66, respectively, matching the inner diameter of a barrel 102 and the outer diameter of a plug 104, respectively, for each of a plurality of barrels 102 having different inner diameters each barrel of which is paired with corresponding one of a plurality of respective plugs 104 having different outer diameters), the chemical solution enclosing device 10 can insert a plug 104 into a barrel 102, for different types of a prefilled syringe 100, only by replacing the plugging head 40.

As illustrated in FIG. 2, the control device 20 in the chemical solution enclosing device 10 is configured to control the barrel conveyor unit 12, the barrel holder unit 14, the plugging unit 16, and the pump 18. That is, the control device 20 controls to move the slide table 24 in the barrel conveyor unit 12, controls to cause to clamp and to unclamp and to raise and to lower the pair of clamping claws 32 in the barrel holder unit 14, controls to raise and to lower the movable head 44 of the plugging unit 16, and also controls the pump 18. The control device 20 includes, for example, a processor such as a CPU or an MPU, and a storage device such as a memory that stores therein a program for causing the processor to execute various operations. An operation of the chemical solution enclosing device 10 caused to execute by the control of the control device 20 will now be described, with a particular focus on a plugging operation for inserting a plug 104 into a barrel 102.

FIGS. 7A to 7F are schematics illustrating a plugging operation for inserting a plug into a barrel.

Figure 7A:
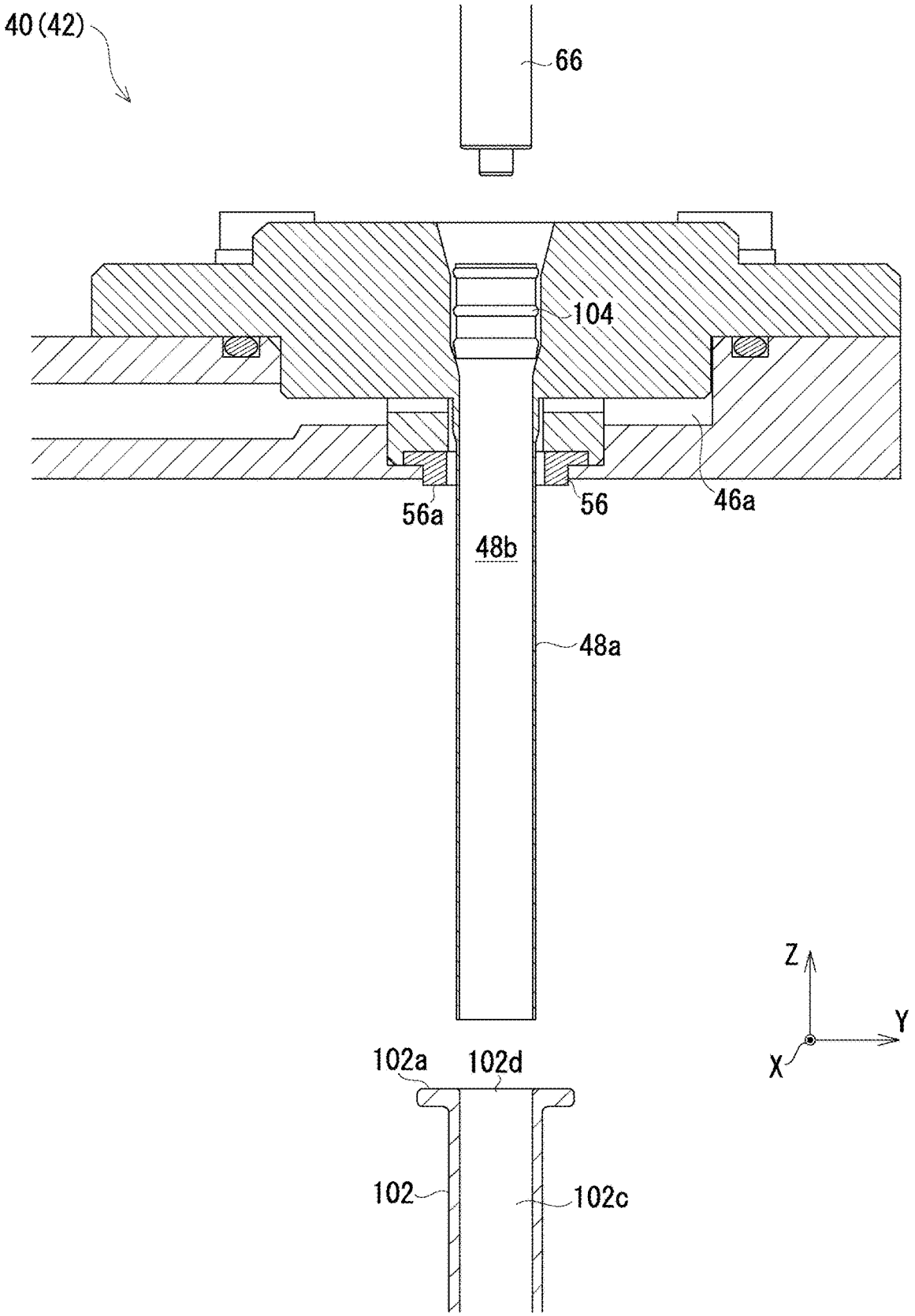
FIG. 7A is a schematic illustrating a plugging operation for inserting a plug into a barrel.

To begin with, as illustrated in FIG. 7A, the barrel conveyor unit 12 places a barrel 102 containing chemical solution W at a plug insertion position, that is, below the fixed head 42 of the plugging head 40, included in the plugging unit 16. Specifically, a barrel 102 is placed at a position where the sleeve 48*a* is allowed to go into the barrel 102 only by moving the sleeve 48*a* relatively with respect to the barrel 102 in the height direction (Z-axis direction).

Figure 7B:
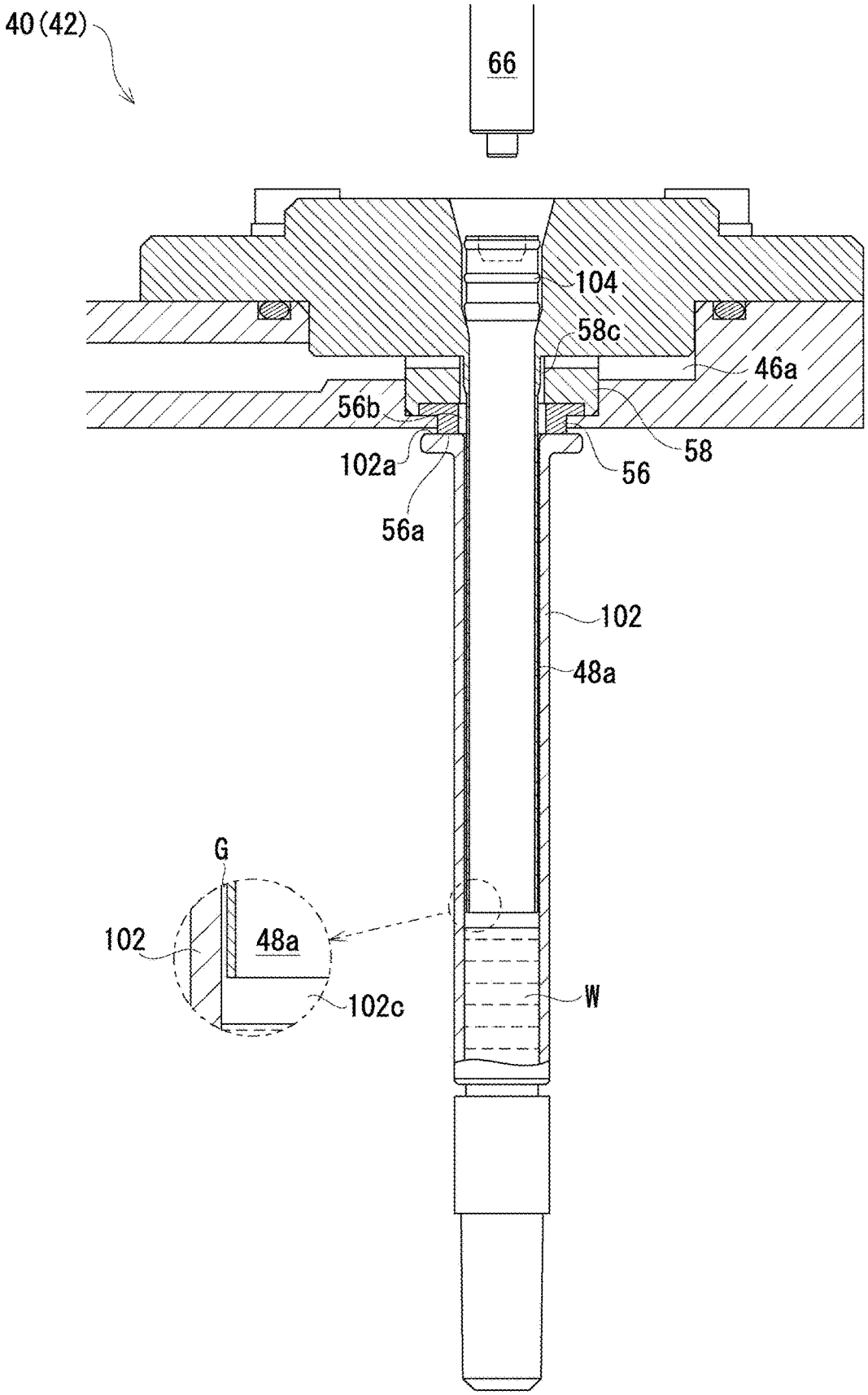
FIG. 7B is a schematic illustrating the plugging operation subsequent to FIG. 7A.

The barrel holder unit 14 then holds the barrel 102 containing the chemical solution W, and raises the held barrel 102 toward the fixed head 42 of the plugging head 40, as illustrated in FIG. 7B. As a result, the sleeve 48*a* is inserted into the barrel 102. The barrel 102 is raised until the proximal end 102*a* of the barrel comes into contact with the contact surface 56*a* of the seal member 56 on the fixed head 42. When the proximal end 102*a* of the barrel 102 comes into contact with the contact surface 56*a*, the tip end of the sleeve 48*a* comes near the liquid surface of the chemical solution W.

As illustrated in FIG. 7B, when the proximal end 102*a* of the barrel 102 comes into contact with the contact surface 56*a* of the seal member 56 on the fixed head 42, the chamber 46*a* of the fixed head 42 becomes communicably connected with the internal space 102*c* of the barrel 102. Specifically, the chamber 46*a* becomes communicably connected with the internal space 102*c* of the barrel 102 through the gap between the inner peripheral surface of the through hole 58*c* of the seal pressing member 58 and the sleeve 48*a*, the gap between the inner peripheral surface of the through hole 56*b* of the seal member 56 and the sleeve 48*a*, and the gap G between the inner peripheral surface of the barrel 102 and the outer peripheral surface of the sleeve 48*a*. The internal space 102*c* of the barrel 102 communicably connected to the chamber 46*a* is thus isolated, by the barrel 102 in contact with the contact surface 56*a* of the seal member 56 on the fixed head 42, the chemical solution W, and the plug 104, from the outer air.

Figure 7C:
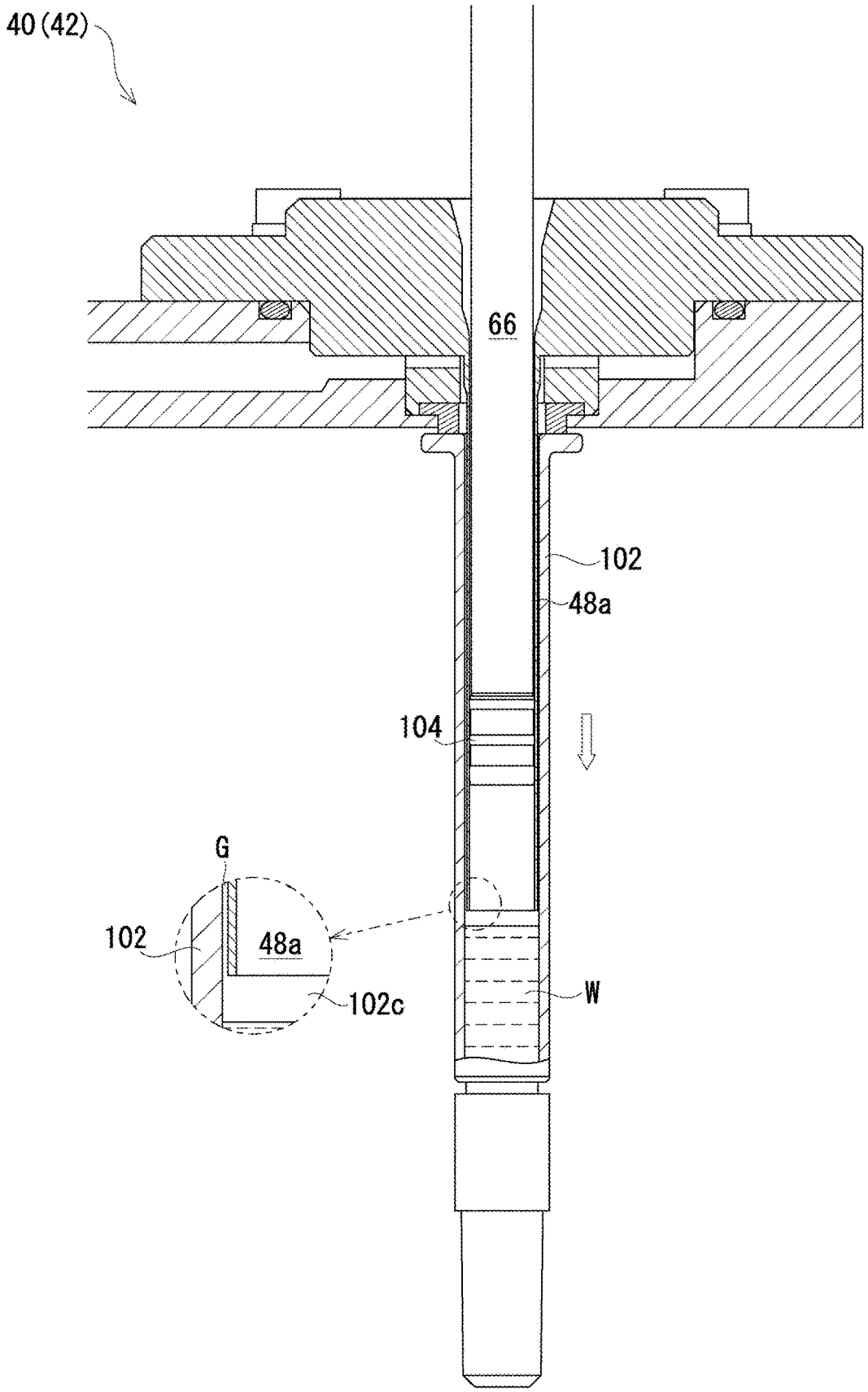
FIG. 7C is a schematic illustrating the plugging operation subsequent to FIG. 7B.

The push rod 66 of the movable head 44 is then moved downwards, thereby advancing the plug 104 having been inserted into the sleeve 48*a* toward the tip end of the sleeve 48*a*, as illustrated in FIG. 7C. At this time, the plug 104 is advanced fluid-tightly in contact with the inner peripheral surface of the sleeve 48*a* (because the inner peripheral surface of the barrel 102 coming into fluid-tight contact with the plug 104 has an inner diameter larger than the outer diameter of the sleeve 48*a*). As a result, the air inside the sleeve 48*a* is pushed out through the gap G between the outer peripheral surface of the sleeve 48*a* and the inner peripheral surface of the barrel 102.

The push rod 66 may place the plug 104 on the tip end of the sleeve 48*a* at the stage illustrated in FIG. 7A, that is, before the proximal end 102*a* of the barrel 102 comes into contact with the contact surface 56*a* of the seal member 56 of the fixed head 42.

Figure 7D:
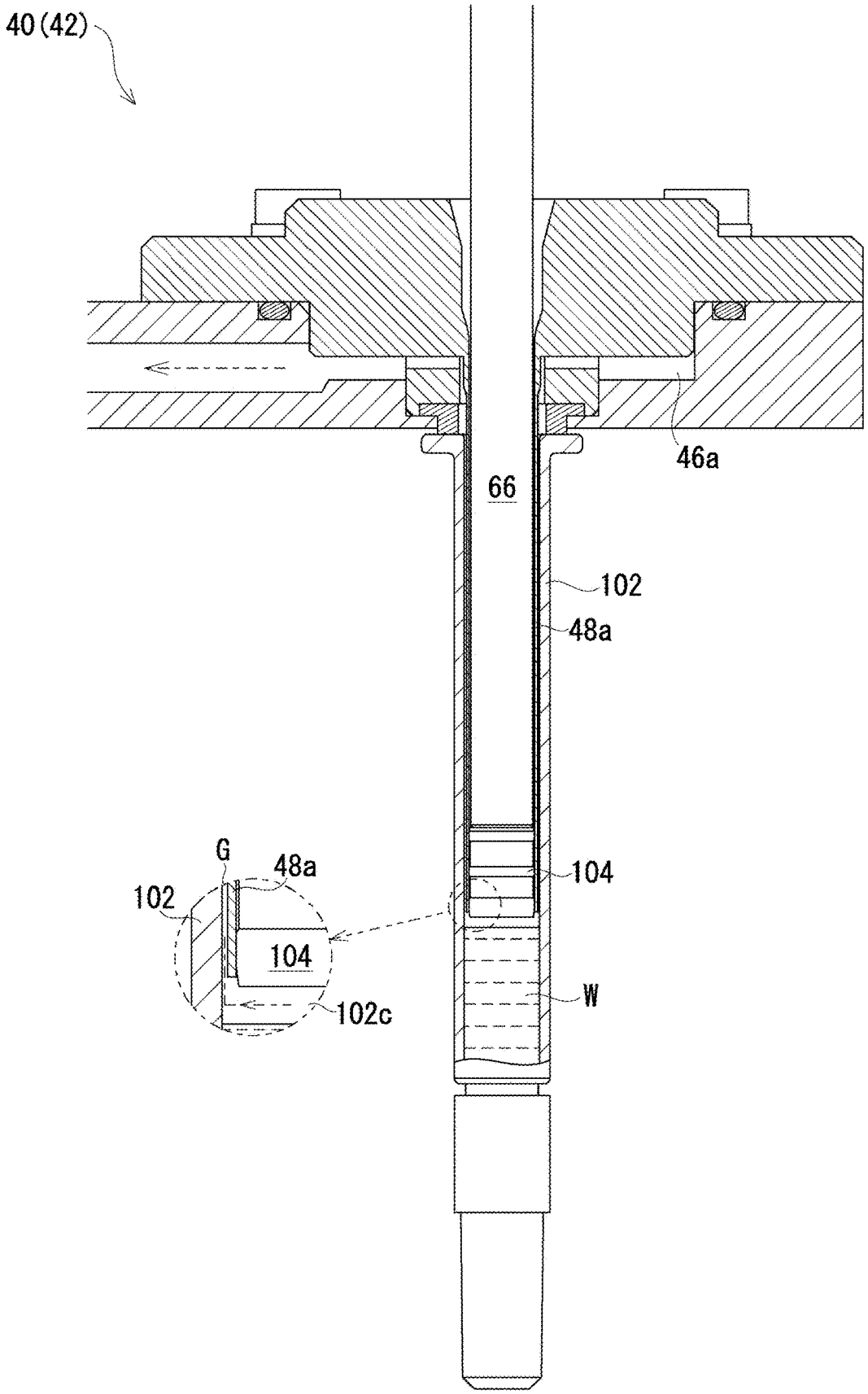
FIG. 7D is a schematic illustrating the plugging operation subsequent to FIG. 7C.

Once the push rod 66 finishes moving the plug 104 toward the tip end of the sleeve 48*a*, the downward movement of the push rod 66 is temporarily stopped, as illustrated in FIG. 7D. The pump 18 is then caused to draw the air inside the barrel 102 through the chamber 46*a*, and through the gap G between the sleeve 48*a* and the inner peripheral surface of the barrel 102, to depressurize the inside of the barrel 102. As a result, the air inside the barrel 102 expands.

The pump 18 may start depressurizing the inside of the barrel 102 at the stage illustrated in FIG. 7B, that is, before the plug 104 is completely moved to the tip end of the sleeve 48*a*. However, when the plug 104 is positioned in the tip end of the sleeve 48*a* before the proximal end 102*a* of the barrel 102 comes into contact with the contact surface 56*a* of the seal member 56 of the fixed head 42, as described above, the volume of the air to be depressurize becomes smaller, so that the pump 18 can depressurize in a shorter length of time. In this manner, the time required in the preparation of a prefilled syringe 100 can be reduced.

When the inside of the barrel 102 is depressurized to a predetermined pressure, the pump 18 is caused to stop drawing. The pressure inside the barrel 102 can be detected using, for example, a pressure sensor installed in the air tube extended between the pump 18 and the air coupler 54. After the pump 18 is stopped, the push rod 66 is started being moved again, to push the plug 104 from the inside of the sleeve 48*a*, into the barrel 102.

Figure 7E:
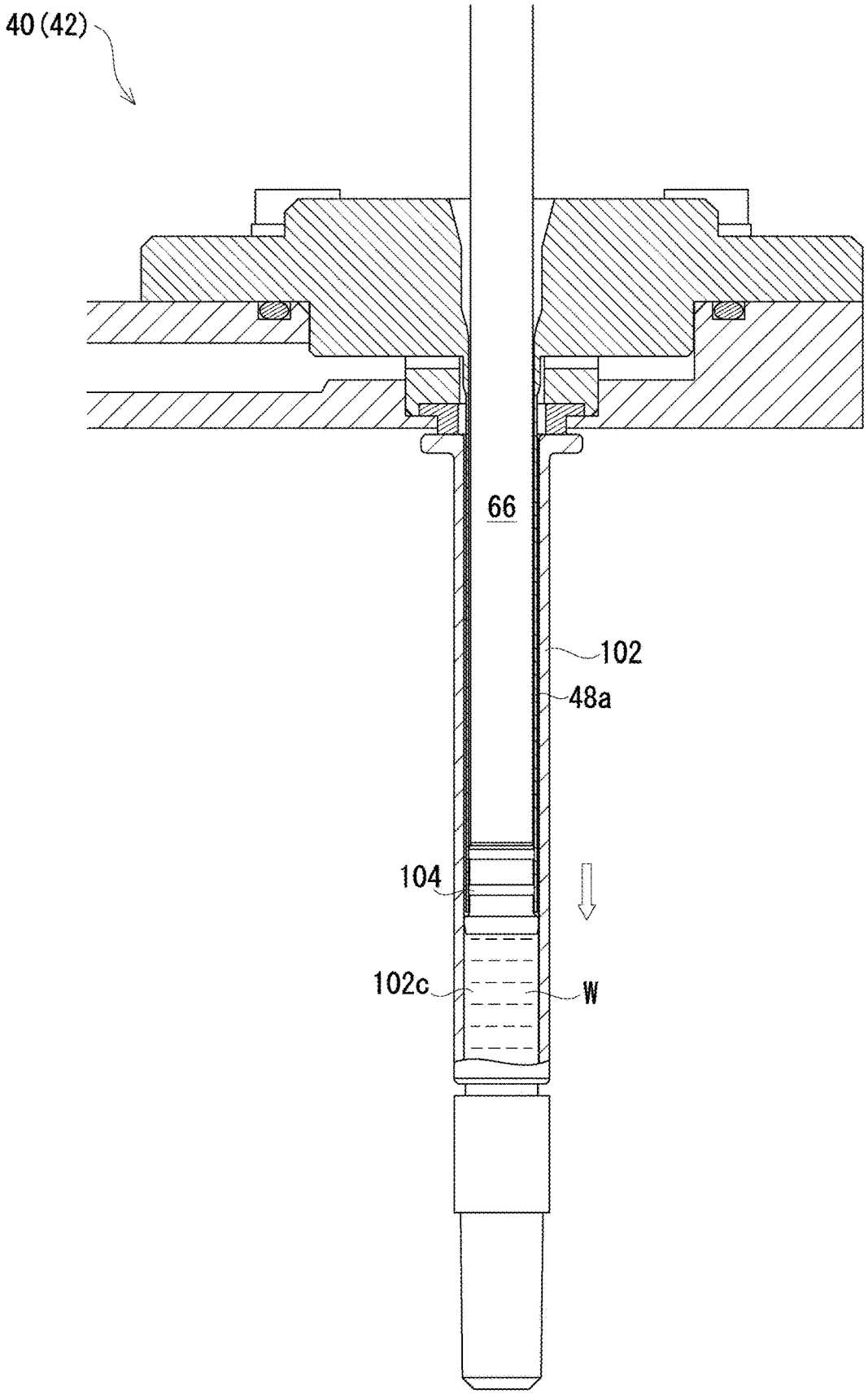
FIG. 7E is a schematic illustrating the plugging operation subsequent to FIG. 7D.

As illustrated in FIG. 7E, as the push rod 66 pushes the plug 104 to a point where a part of the plug 104 comes out of the sleeve 48*a*, the outer peripheral surface of the part comes into fluid-tight contact with the inner peripheral surface of the barrel 102. As a result, the part of the internal space 102*c* of the barrel 102 below the plug 104 becomes sealed. The pressure inside the sealed part of the internal space 102*c*, being sealed by the plug 104, is returned to approximately atmospheric pressure, and a very slight amount of remaining air becomes compressed. As a result, the sealed part of the internal space 102*c*, being sealed by the plug 104, is filled with the chemical solution W with a formation of air bubbles inhibited.

The push rod 66 keeps advancing the plug 104 until the entire plug 104 goes into the barrel 102.

Figure 7F:
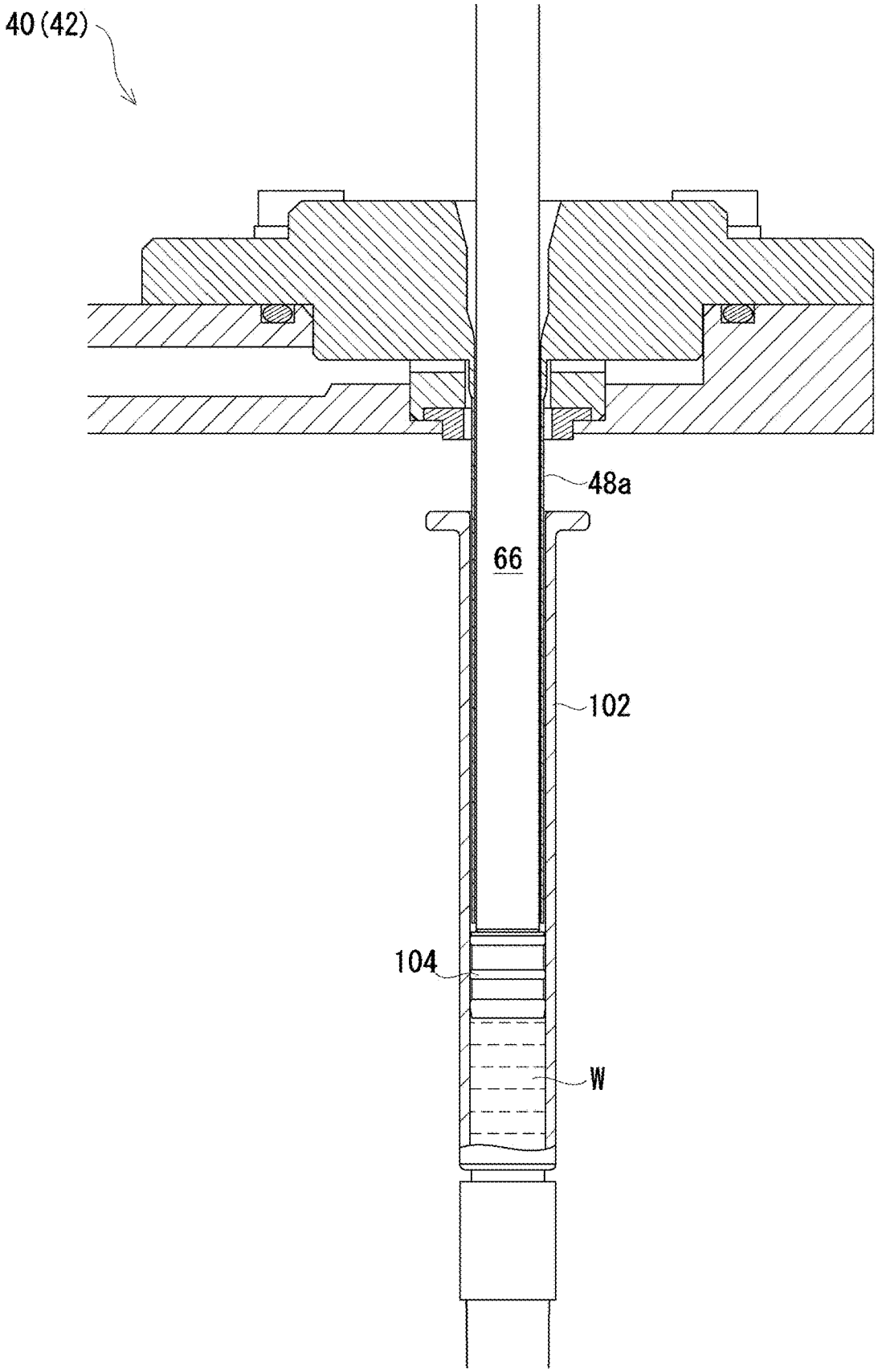
FIG. 7F is a schematic illustrating the plugging operation subsequent to FIG. 7E.

Once the entire plug 104 goes into the barrel 102, the sleeve 48*a* is withdrawn from the barrel 102, as illustrated in FIG. 7F. In the example according to the present embodiment, the sleeve 48*a* is withdrawn from the inside of the barrel 102 by causing the barrel holder unit 14 to move the barrel 102 downwards.

Note that it is also possible to start withdrawing the sleeve 48*a* from the inside of the barrel 102 at the stage illustrated in FIG. 7E, that is, immediately after a part of the outer peripheral surface of the plug 104 comes into fluid-tight contact with the inner peripheral surface of the barrel 102. In such a case, it is preferable for the push rod 66 to be kept without moving, that is, to be kept in contact with the plug 104. If the sleeve 48*a* is withdrawn while the remaining part of the plug 104 is still inside the sleeve 48*a*, the plug 104 may also become moved with respect to the barrel 102, by being pulled along the sleeve 48*a*. Therefore, by keeping the push rod 66 without moving, the push rod 66 functions as a stopper that restricts the movement of the plug 104 in the direction in which the sleeve 48*a* is withdrawn. As a result, the plug 104 is left in place within the barrel 102, without moving inside the barrel 102.

According to the present embodiment as described above, it is possible to insert the plug into the barrel containing the chemical solution, without increasing the size of the device, that is, without using a vacuum chamber.

Although the present disclosure has been explained with reference to the embodiment described above, the embodiment of the present disclosure is not limited thereto.

For example, in the case of the embodiment described above, the sleeve 48*a* is kept at a fixed height position, and the barrel 102 is moved up and down using the barrel holder unit 14. With this movement, the sleeve 48*a* is moved in and out of the barrel 102. However, the embodiment of the present disclosure is not limited thereto. It is also possible for the barrel 102 to be provided at a fixed height position, and for the sleeve 48*a* to be moved up and down.

That is, a chemical solution enclosing device according to an embodiment of the present disclosure is, in a broad sense, a chemical solution enclosing device that inserts a plug into a barrel containing a chemical solution includes, a barrel holder unit configured to hold the barrel, a sleeve inserted into the barrel held by the barrel holder unit in such a manner that a tip end of the sleeve comes near a liquid surface of the chemical solution; a push rod configured to push the plug inserted in the sleeve, and a suction depressurization device that draws air inside of the barrel that is isolated from outer air, the air being drawn through a gap between an outer peripheral surface of the sleeve and an inner peripheral surface of the barrel to depressurize inside of the barrel, wherein after the suction depressurization device depressurizes the inside of the barrel to a predetermined pressure, the push rod is advanced to push the plug from inside of the sleeve into the barrel, with a depressurized state maintained, and the sleeve is withdrawn from the barrel after at least a part of an outer peripheral surface of the plug comes into fluid-tight contact with the inner peripheral surface of the barrel.

Also, a chemical solution enclosing method according to another embodiment of the present disclosure is, in a broad sense, a chemical solution enclosing method for inserting a plug into a barrel containing a chemical solution includes, inserting a sleeve into the barrel in such a manner that a tip end of the sleeve comes near a liquid surface of the chemical solution, inserting the plug into the sleeve, drawing air inside of the barrel that is isolated from outer air, the air being drawn through a gap between an outer peripheral surface of the sleeve and an inner peripheral surface of the barrel, using a suction depressurization device, to depressurize the inside of the barrel, advancing the plug from inside of the sleeve into the barrel, after the suction depressurization device depressurizes the inside of the barrel to a predetermined pressure, with a depressurized state maintained, and withdrawing the sleeve out of the barrel after at least a part of the outer peripheral surface of the plug comes into fluid-tight contact with the inner peripheral surface of the barrel.

Although the number of prefilled syringes manufactured at a time is not mentioned in the embodiment, one prefilled syringe may be manufactured at a time, or two prefilled syringes may be manufactured at a time, as illustrated in FIGS. 1, 4, and 5. It is also possible to manufacture three or more prefilled syringes at a time.

It is also possible to plug a vial without using vacuuming at the time of plugging, by replacing the clamping claws 32 and the like in the embodiment described above, although detailed description thereof is omitted.

INDUSTRIAL APPLICABILITY

The present disclosure is applicable to manufacturing of a prefilled syringe or a cartridge for an auto injector, with a plug inserted into a barrel containing a chemical solution.

The invention claimed is:

1. A device configured to insert a plug into a barrel containing a chemical solution, the device comprising:

a barrel holder unit configured to hold the barrel;

a sleeve configured to be inserted into the barrel held by the barrel holder unit in such a manner that a tip end of the sleeve comes near a liquid surface of the chemical solution;

a push rod configured to push the plug inserted in the sleeve; and a suction depressurization device that draws air inside of the barrel that is isolated from outer air, the air being drawn through a gap between an outer peripheral surface of the sleeve and an inner peripheral surface of the barrel to depressurize inside of the barrel, wherein after the suction depressurization device depressurizes the inside of the barrel to a predetermined pressure, the push rod is advanced to push the plug from inside of the sleeve into the barrel, with a depressurized state maintained, and the sleeve is withdrawn from the barrel after at least a part of an outer peripheral surface of the plug comes into fluid-tight contact with the inner peripheral surface of the barrel.

2. The device according to claim 1, wherein the device is configured so that the push rod is stopped being moved once a part of the outer peripheral surface of the plug comes into fluid-tight contact with the inner peripheral surface of the barrel, and the sleeve is withdrawn from the barrel without moving the push rod.

3. The device according to claim 1, wherein the barrel holder unit includes a pair of clamping claws that clamp the barrel in radial directions of the barrel.

4. The device according to claim 1, wherein the barrel holder unit is configured to raise and to lower the barrel.

5. The device according to claim 1, wherein the suction depressurization device is a pump or an ejector.

6. The device according to claim 1, wherein after the plug having been in the tip end of the sleeve, the suction depressurization device draws the air inside the barrel to depressurize the inside of the barrel.

7. The device according to claim 1, wherein the push rod is moved so that the push rod keeps advancing the plug from the sleeve to the barrel until the entire plug goes into the barrel, and after the entire plug having been in the barrel, the sleeve is withdrawn from the inside of the barrel.

8. The device according to claim 1, wherein a movement of the push rod is temporarily stopped after the plug having been in the tip end of the sleeve by the push rod, after the push rod being temporarily stopped, the suction depressurization device depressurizes the inside of the barrel, after depressurizing the inside of the barrel to a predetermined pressure, the depressurized state is maintained by stopping a drawing of the suction depressurization device, and in the depressurized state, the push rod is started being moved again, to push the entire plug from the inside of the sleeve into the barrel.

9. The device according to claim 1, further comprising:

a seal member including a through hole through which the sleeve is passed and a contact surface coming into contact with a proximal end of the barrel located on an insertion side of the sleeve, and wherein an internal space of the barrel is isolated from an outer air by the barrel contacting with the contact surface of the seal member, the chemical solution, and the plug.

10. The device according to claim 9, wherein the push rod pushes the plug being inserted in the sleeve to the tip end of the sleeve after the proximal end of the barrel having contacted with the contact surface of the seal member.

11. The device according to claim 1, further comprising:

a base member including a recessed chamber having a through hole which provided on a bottom surface of the chamber and which the sleeve passes through; and a cover member covering the chamber and including the sleeve and an opening provided on the cover member so that the plug is inserted into the internal space of the sleeve, wherein the base member includes an internal channel connecting the chamber with the suction depressurization device and has an outlet to which an air coupler is attached, the suction depressurization device and the air coupler are connected by an air tube in which a pressure sensor is installed, and an air in the chamber is drawn by the suction depressurization device through the internal channel and the air coupler, and detected in pressure by the pressure sensor.

12. A chemical solution enclosing method for inserting a plug into a barrel containing a chemical solution, the chemical solution enclosing method comprising:

inserting a sleeve into the barrel in such a manner that a tip end of the sleeve comes near a liquid surface of the chemical solution;

inserting the plug into the sleeve;

drawing air inside of the barrel that is isolated from outer air, the air being drawn through a gap between an outer peripheral surface of the sleeve and an inner peripheral surface of the barrel, using a suction depressurization device, to depressurize the inside of the barrel;

advancing the plug from inside of the sleeve into the barrel, after the suction depressurization device depressurizes the inside of the barrel to a predetermined pressure, with a depressurized state maintained; and withdrawing the sleeve out of the barrel after at least a part of the outer peripheral surface of the plug comes into fluid-tight contact with the inner peripheral surface of the barrel.

13. The chemical solution enclosing method according to claim 12, wherein the suction depressurization device is a pump or an ejector.

14. The chemical solution enclosing method according to claim 12, wherein using the suction depressurization device to depressurize the inside of the barrel includes using the suction depressurization device to depressurize the inside of the barrel to a predetermined pressure, the method further comprising:

while maintaining the depressurized state, moving the push rod to push the plug from the inside of the sleeve into the barrel, stopping a movement of the push rod after the part of the outer peripheral surface of the plug coming into fluid-tight contact with the inner peripheral surface of the barrel, and while maintaining the stop of push rod, withdrawing the sleeve out of the barrel.

15. The chemical solution enclosing method according to claim 12, further comprising:

drawing the air inside the barrel by the suction depressurization device to depressurize the inside of the barrel after the plug having been in the tip end of the sleeve.

16. The chemical solution enclosing method according to claim 12, further comprising:

moving the plug from the inside of the sleeve into the barrel until the entire plug goes into the barrel, and withdrawing the sleeve from the inside of the barrel after the entire plug having been in the barrel.

17. The chemical solution enclosing method according to claim 12, further comprising:

temporarily stopping a movement of the push rod after the plug having been in the tip end of the sleeve, depressurizing the inside of the barrel by the suction depressurization device after the push rod being temporarily stopped, maintaining the depressurized state by stopping a drawing of the suction depressurization device after depressurizing the inside of the barrel to a predetermined pressure, and while maintaining the depressurized state, moving the plug from the inside of the sleeve into the barrel.

18. The chemical solution enclosing method according to claim 12, further comprising:

coming contact with a proximal end of the barrel located on an insertion side of the sleeve to a seal member, the seal member including a through hole through which the sleeve is passed and a contact surface coming into contact with the proximal end of the barrel, and isolating an internal space of the barrel from an outer air by the barrel contacting with the contact surface of the seal member, the chemical solution, and the plug when contacting the proximal end of the barrel with the contact surface of the seal member.

19. The chemical solution enclosing method according to claim 18, further comprising:

pushing the plug being inserted in the sleeve to the tip end of the sleeve after the proximal end of the barrel having contacted with the contact surface of the seal member.

* * * * *